US008397936B2

(12) United States Patent
Schleining

(10) Patent No.: US 8,397,936 B2
(45) Date of Patent: Mar. 19, 2013

(54) PACKAGE FOR TRANSPORTING FOODSTUFF

(75) Inventor: Walter Schleining, Tribuswinkel (AT)

(73) Assignee: Ovotherm International Handels GmbH, WR.Neudorf (AT)

( * ) Notice: Subject to any disclaimer, the term of this patent is extended or adjusted under 35 U.S.C. 154(b) by 327 days.

(21) Appl. No.: 12/782,955

(22) Filed: May 19, 2010

(65) Prior Publication Data

US 2011/0121000 A1 May 26, 2011

(30) Foreign Application Priority Data

May 22, 2009 (AT) ..... GM326/2009

(51) Int. Cl.
*B65D 1/36* (2006.01)
*B65D 85/00* (2006.01)
*B65D 43/10* (2006.01)

(52) U.S. Cl. ..... 220/507; 220/500; 220/508; 220/516; 220/780; 220/783; 220/784; 220/788; 206/521.1

(58) Field of Classification Search ..... 220/500, 220/507, 508, 516, 780, 782, 783, 784, 788, 220/789, 790; 206/521.1
See application file for complete search history.

(56) References Cited

U.S. PATENT DOCUMENTS

| | | | | |
|---|---|---|---|---|
| 2,974,842 | A * | 3/1961 | Reifers | 206/521.1 |
| 3,421,682 | A * | 1/1969 | Eisenbach | 206/502 |
| 3,655,110 | A * | 4/1972 | Eisenbach | 229/406 |
| 3,661,317 | A * | 5/1972 | Noguchi | 206/521.1 |
| 4,057,188 | A * | 11/1977 | Steinhardt | 206/521.8 |
| 4,205,777 | A * | 6/1980 | Brown et al. | 206/521.1 |
| 7,258,234 | B2 * | 8/2007 | Aardema et al. | 206/521.1 |

FOREIGN PATENT DOCUMENTS

AT 503453 B 10/2007

* cited by examiner

*Primary Examiner* — Anthony Stashick
*Assistant Examiner* — Madison L Poos
(74) *Attorney, Agent, or Firm* — Andrew Wilford

(57) ABSTRACT

A package has a base for holding foodstuff objects, a cover fittable downwardly over the lid and having a rim with a rear edge and a front edge parallel thereto, and a hinge interconnecting the cover and base at the rear edge for movement between an open position with the rims separated at the front edge and a closed position with the rims engaging each other at the front edge. A female formation open vertically at one of the rims toward the other of the rims has a recess with a rear side formed by a forwardly projecting counterhook and a front side defined by a flank extending vertically forward and toward the other rim. A male formation projecting vertically from the other of the rims toward the one rim is fittable into the recess and has a hook matable with the counterhook.

11 Claims, 2 Drawing Sheets

PACKAGE FOR TRANSPORTING FOODSTUFF

FIELD OF THE INVENTION

The present invention relates to a package for transporting foodstuff. More particularly this invention concerns a carton for shipping eggs, cherry tomatoes, or the like.

BACKGROUND OF THE INVENTION

Such packages are characterized by a low weight and a thin wall thickness compared to similar packages made from cardboard and thus can be closely stacked. Apart from that, they appear more attractive for sale, specifically when they are made from transparent material.

An egg package of the above mentioned type is known from AT 503453. Here, latches are used, whose female and the male formations both have a substantially round shape and the plug of the male formation is tapered toward the hook. However, the female and male formations are intended to take up as little space as possible for which reason the latches are designed as small as possible. To ensure that the positioning can still be carried out as exactly as possible, therefore, additional projections are provided on the lid, and diametrically opposing recesses are provided in the base.

Exact positioning is essential because most of the packers fill the packages automatically and the machines work very fast, and to sort out packages which are not properly filled involves high operating expenses. Further, it is important for the transport that the positioning be exactly maintained and no shifting between lid and base takes place.

The disadvantage of this known package is that the round shape of the latches, even if they are small, project far into the package which affects the top surface in such a manner that only a small area is available for labeling. Moreover, a relatively high pressure is necessary to engage a hook of a latch with the counter hook. Because of this packages are often not closed properly in automatic package machines.

OBJECTS OF THE INVENTION

It is therefore an object of the present invention to provide an improved package for transporting foodstuff.

Another object is the provision of such an improved package for transporting foodstuff such as eggs, cherry tomatoes, or the like that overcomes the above-given disadvantages, in particular that where the area available for a label is as large as possible and does not only not comprise the top surface of the lid but also the area of the lid extending downward from the lid area to the contact edge of lid and base.

Furthermore, it must be possible that the male formation with its hook slides easily into the female formation and, if the positioning is not very exact, slides into the recess of the female formation by applying light pressure on the lid of the package.

Moreover, the pressure for closing the package is to be as low as possible but unintended disengaging of the male formation from the female formation during transportation must be ruled out, if possible.

SUMMARY OF THE INVENTION

A package for holding a plurality of foodstuff objects has according to the invention a base for holding the foodstuff objects, a cover fittable downwardly over the lid and having a rim with a rear edge and a front edge parallel thereto, and a hinge interconnecting the cover and base at the rear edge for movement between an open position with the rims separated at the front edge and a closed position with the rims engaging each other at the front edge. A female formation open vertically at one of the rims toward the other of the rims has a recess with a rear side formed by a forwardly projecting counterhook and a front side defined by a flank extending vertically forward and toward the other rim. A male formation projecting vertically from the other of the rims toward the one rim is fittable into the recess and has a hook matable with the counterhook. The male and female formation are of rectangular section. The recess has a front-to-rear dimension between the counter hook and the flank that is smaller than a front-to-rear dimension of the hook of the male formation so that the female formation deforms elastically on entry of the hook into the recess past the counterhook.

When closing, the counter hook is slightly pushed away by the hook and the hook slides into the recess of the female formation and reaches the engaged position of the hook and counterhook. However, to release the latch, a significantly higher force is necessary because the counterhook must be pulled upward until it is high enough that there is enough space between the counterhook and the opposing angular face for the hook to pass through. The reason for this is that when the package is closed, the abutting surfaces of hook and counterhook are arranged approximately normal to the opening force so that no force component exists to push the counterhook to the side. Due to the approximately rectangular cross-section, the latch can be very thin but can still support high loads so that it requires less space so that the obtained extra space is additionally available to hold a label. In particular, it is also possible to form the front side evenly (without recess for the latches) so that this side is also available for labeling.

It is advantageous if the counterhook has a flattened head, the head surface of which projects into the recess of the female formation and represents substantially a flattened part-cylindrical surface. This way, closing is made easier because with increasing depth, the part-cylindrical surface becomes steeper so that, with increasing counter force, the wedge angle becomes more advantageous so that the force during closing (when pushing away the counterhook) remains approximately constant.

To make a deflection of the counterhook easier when closing the package, the counterhook is spaced apart from the narrow sides of the recesses. Thereby, the force required for closing is reduced again because elastic deformation can take place in the region generated by the spacing.

According to a further feature of the invention, the base or the lid has at least one additional projection which is closer to the hinge than the latch, and the other part has at least one setback opposing at least a region for receiving the plug for centering the lid on the base. By this measure, the positioning of the lid with respect to the base is defined more exactly than by the latches alone.

It is advantageous if at least one edge length between two latches has at least one region where, in the closed state of the package, the edges of base and lid have a spacing that corresponds approximately to the diameter of a human finger. In this manner, opening the package is made easier. By inserting a finger between the edges of base and lid between two latches, the package is opened.

It is advantageous if the female formation is integrally formed from a flat surface parallel to the edge to which the latch is attached but which is raised with respect to the edge in such a manner that the female formation is situated substantially above the edge. This way the latch does not project from underneath the edge of the base and, furthermore, due to the elevation of the female formation with respect to the edge, it is substantially possible to generate the finger slot for opening the package.

It is advantageous if the lid has a reinforcement rib on the front side which is angular over a large area, the rib extending at least from a latch to the top surface of the lid and running parallel to a plane adjacent the angular front side. This provides additional stability for the package in the region of the latches.

According to a further feature of the invention, the hinge consists of two hinges, preferably film hinges, which extend parallel to one another and which are spaced apart from one another and connected to one another by a rib. Thereby, the individual hinges are bent only by 90° when the lid is pivoted by 180°.

For protected reception of the individual items of the food to be transported it is of advantage if the base of the package has pockets for receiving the individual items of the food to be transported. This is in particular common for egg packages.

To avoid compression of the package and thus crushing of the food to be transported, it is advantageous to provide projections on the base which, when the lid is closed, abut against it.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
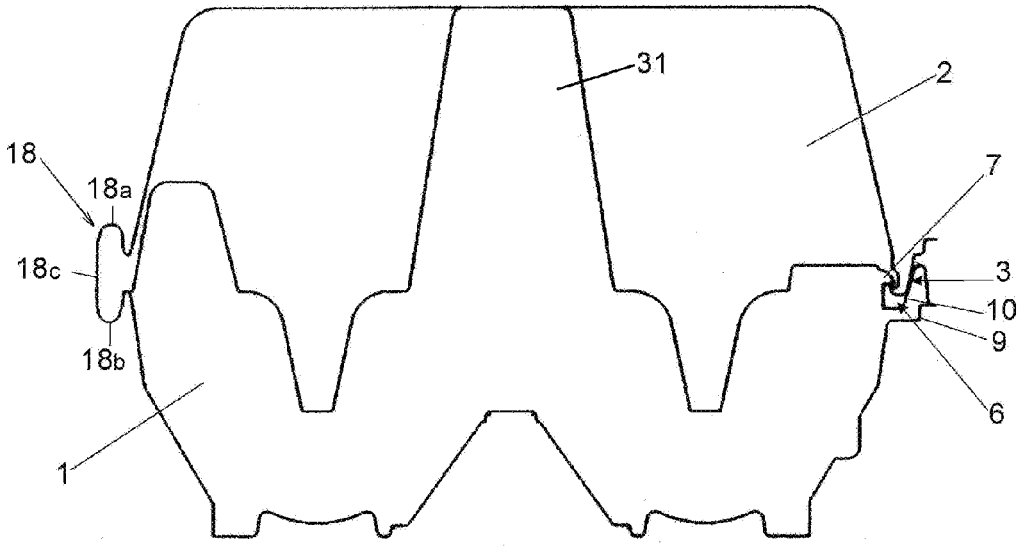
FIG. 1 is a cross section through the package when closed, perpendicular to the pivot axis of the hinge.
Figure 2:
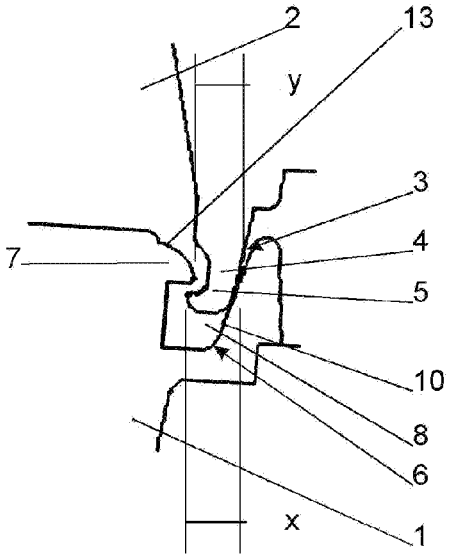
FIG. 2 is an enlarged cross-sectional view of a detail of the latch.
Figure 3:
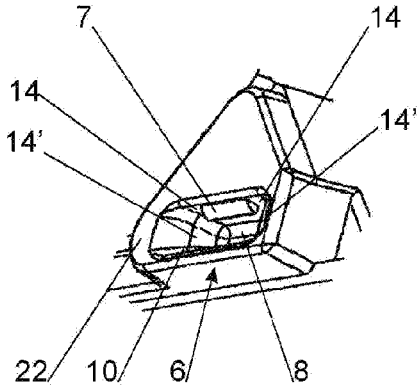
FIG. 3 is a perspective view of the lower part of the latch, seen from above.

As seen in FIG. 1 a package according to the invention has a base 1 and a cover 2 connected to one another along a rear edge by a hinge 18. On a front edge 9 opposite the hinge 18, a latch is provided having a male formation 3 and a female formation 6. The male formation 3 has a plug 4 forming a downwardly extending and rearwardly open hook 5. The female formation 6 consists substantially of a recess 8 having one angular face 10, an upwardly projecting and forwardly open counterhook 7 being integrally formed in the opposite face. The counterhook 7 has an upper surface 13 of part-cylindrical shape (see FIG. 3) directed forward and upward.

When closing the package, the plug 4 and hook 5 of the male formation 3 slide along on the planar and angled front flank 10 extending upward and outward and closing the front side of the recess 8 and over the surface 13 of the counterhook 7 at the rear side of the recess 8. Since a distance y between the counterhook 7 and the opposing angled face 10 is smaller than the front-to-rear thickness x of the hook 5, the counterhook 7 must be pushed slightly inward. This is possible because the counterhook 7 has a spacing 14 from each of two narrow sides 14' of the recess 8 so that, by deforming the resultingly narrowed sides at the regions that form the spacings 14, the counterhook 7 can be pushed away with little force. In other words the recess 8 is spread elastically front to rear. In the closed position as shown in FIG. 1 a bump 31 on the base 1 engages the cover 2.

Figure 4:
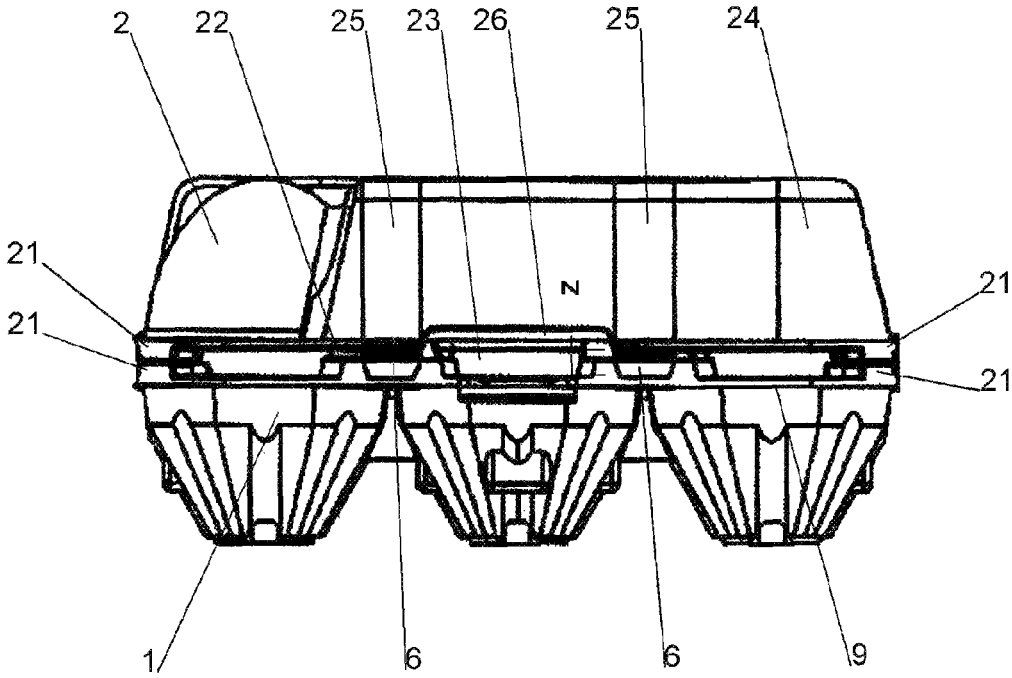
FIG. 4 is a front side view of the package.
Figure 5:
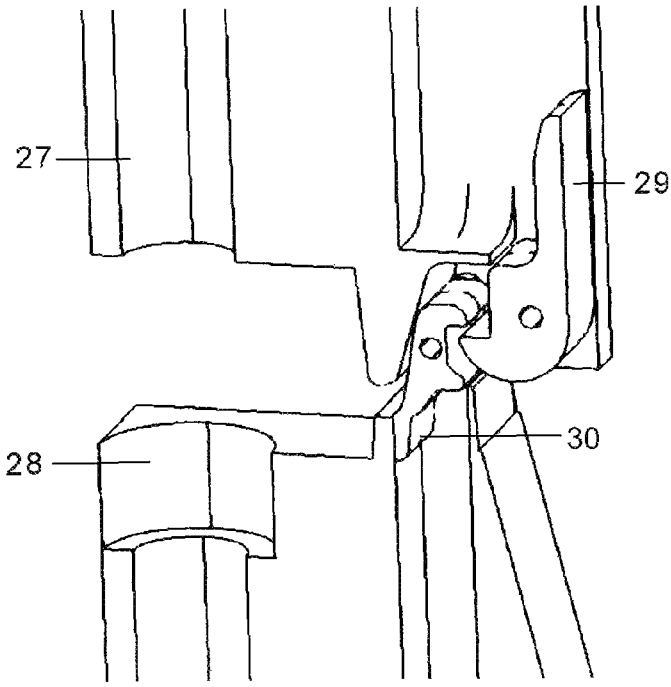
FIG. 5 is a perspective view of a tool for forming the latch.

As can be seen in FIG. 4, the cover 2 and base 1 have rims 21 at which they can abut against each other when the package is closed. The female formation 6 opens upward at a flat face 22 that is parallel to the edge 9 to which the latch is attached, but that is raised with respect to the edge 9 in such a manner that the female formation 6 is substantially above the edge 9. A shallow setback in the cover 2 forms a region 23 where between cover 2 and base 1 a spacing z exists that corresponds approximately to the thickness of a human finger. If a finger is inserted in the region 23 and pulls the cover 2 forward and upward, the package springs open relatively easily. On the inner side of this region 23, the cover 2 has a corresponding chamfer or step 26.

The cover 2 has a reinforcement rib 25 on the front side 24 which is angular over a large area, the rib 25 extending from the male formation 3 to the top surface of the cover 2 and running parallel to a plane adjacent to the front side 24.

In addition as shown in FIG. 1, the hinge 18 has three parts, namely two film hinges 18*a* and 18*b* separated by a stiff rib 18*c*. This way on movement through 180° between an open and a closed position, each hinge 18*a* or 18*b* only has to flex 90°.

Since the hook 5 and the counterhook 7 are undercut, a special mold for deep-drawing has two parts 27 and 28 in which movable hooks 29 and 30 are provided, is necessary. By swiveling these movable hooks 29 and 30, the deep-drawn package formed from closed-cell foam can be removed from the mold

I claim:

1. A package for holding a plurality of foodstuff objects, the package comprising:

a base for holding the foodstuff objects and having an upwardly directed rim with a rear edge and a front edge parallel thereto;

a cover fittable downwardly over the base and having a downwardly directed rim with a rear edge and a front edge parallel thereto;

a hinge interconnecting the cover and base at the rims at the rear edges for movement between an open position with the rims separated at the front edges and a closed position with the rims engaging each other at the front edges;

a female formation open vertically at the front edge on one of the rims toward the other of the rims and having a recess open toward the cover and having a rear side formed by a forwardly projecting counterhook and a front side defined by a flank extending vertically forward and toward the other rim; and a male formation projecting vertically from the other of the rims toward the one rim, fittable into the recess, and having a hook matable with the counterhook, the male and female formations being of rectangular section, the recess having a front-to-rear dimension between the counterhook and the flank that is smaller than a front-to-rear dimension of the hook of the male formation such that, on engagement of the male formation into the female formation, the male formation engages both sides of the recess of the female formation so that the female formation spreads and deforms elastically on entry of the hook into the recess past the counterhook.

2. The package defined in claim 1 wherein the cover and base are unitarily formed with each other and with the respective hinge and formations of a deep-drawn plastic.

3. The package defined in claim 1 wherein the counterhook has a vertically and forwardly directed generally part cylindrical surface engageable with the hook on closing of the package.

4. The package defined in claim 3 wherein the counterhook is shorter than the recess and is separated from ends of the recess by spacings.

5. The package defined in claim 1 wherein one of the rims is formed at the front edge with a forwardly open setback and the other of the rims is formed at the respective front edge with a rearward projection aligned with the setback and in the closed position the setback and the projection are spaced apart sufficiently that a user can insert a finger between them and pry up the cover.

6. The package defined in claim 1 wherein the male formation extends vertically past the respective rim on which it is formed.

7. The package defined in claim 1 wherein the cover is formed with at least one reinforcement rib extending to the respective rim.

8. The package defined in claim 1 wherein the hinge is a film hinge formed unitarily with the cover and base.

9. The package defined in claim 8 wherein the film hinge has two parts space apart by a rib, whereby for 180° movement between fully open and closed positions each hinge part has only to pivot through 90°.

10. The package defined in claim 1 wherein the base is formed with pockets for holding the foodstuff objects.

11. The package defined in claim 1 wherein the base part is formed with an upwardly projecting bump and the cover engages the bump in the closed position.

* * * * *